US007318383B1

(12) United States Patent
Ingram

(10) Patent No.: US 7,318,383 B1
(45) Date of Patent: Jan. 15, 2008

(54) NARROW GAUGE HOLLOW NEEDLE TUFTING APPARATUS

(75) Inventor: Gary L. Ingram, Ooltewah, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 11/452,160

(22) Filed: Jun. 13, 2006

(51) Int. Cl.
*D05C 15/10* (2006.01)
*D05C 15/24* (2006.01)

(52) U.S. Cl. ..... 112/80.4; 112/80.7

(58) Field of Classification Search ..... 112/80.05, 112/80.08, 80.16, 80.3, 80.32, 50.45, 80.5, 112/80.55, 260, 222, 226, 227, 80.4; 83/284, 83/938
See application file for complete search history.

(56) References Cited

U.S. PATENT DOCUMENTS 398,708 A * 2/1889 Card ..... 73/270
1,264,538 A * 4/1918 McNeil ..... 112/260
2,975,736 A * 3/1961 Card ..... 112/80.5
2,983,028 A * 5/1961 Cole ..... 428/85
3,217,676 A * 11/1965 Short ..... 112/80.08
3,324,812 A * 6/1967 Smith ..... 112/80.55
3,356,049 A * 12/1967 Short ..... 112/80.08
3,361,095 A * 1/1968 Short ..... 112/80.16
3,533,368 A * 10/1970 Finster ..... 112/227
4,503,787 A * 3/1985 Watkins ..... 112/80.3
4,549,496 A 10/1985 Kile
4,991,523 A 2/1991 Ingram
5,080,028 A 1/1992 Ingram
5,158,027 A 10/1992 Ingram
5,165,352 A 11/1992 Ingram
5,205,233 A 4/1993 Ingram
5,267,520 A 12/1993 Ingram
5,404,605 A 4/1995 Samilo
5,511,398 A 4/1996 Samilo
5,588,383 A 12/1996 Davis et al.
6,202,580 B1 3/2001 Samilo
6,293,211 B1 9/2001 Samilo
6,401,639 B1 6/2002 Samilo

* cited by examiner

*Primary Examiner*—Ismael Izaguirre
(74) *Attorney, Agent, or Firm*—Douglas T. Johnson

(57) ABSTRACT

A narrow gauge hollow needle tufting apparatus is provided with longitudinally aligned yarn feed openings, longitudinal funnel slots, self aligning hollow needles, and a castellated backing support bar.

18 Claims, 6 Drawing Sheets

NARROW GAUGE HOLLOW NEEDLE TUFTING APPARATUS

FIELD OF THE INVENTION

The present invention relates to tufting apparatus for producing patterned textile goods such as carpet, upholstery, and the like, and more particularly to tufting apparatus utilizing hollow needles to which a plurality of yarns are selectively fed.

BACKGROUND OF THE INVENTION

In most hollow needle tufting machines, as typified by Kile, U.S. Pat. No. 4,549,496 and Davis, at al., U.S. Pat. No. 5,588,383, each hollow needle is laterally spaced apart from the next needle by a distance of at least 2 inches and in some instances up to about 2 or 3 feet. This spacing has been necessary because of the complexity of the apparatus required to selectively feed one of the plurality of yarns for tufting by the hollow needle and then to remove the tufted yarn and replace it with another selected yarn to produce a change of color. A disadvantage of this spacing is that for hollow needles spaced on 2 inch centers, it is necessary to sew 20 lateral stitches in order to complete one row of tenth gauge spaced stitching before the backing fabric can be advanced and another row of stitching begun. For even finer gauge stitches of one-sixteenth gauge spacing, 32 lateral stitches are required before advancing to the next row. In this instance, even if the tufting machine is achieving about 900 stitches per minute, the stitch rate is only sufficient to tuft 30 rows of stitches in the backing fabric per minute. Since high speed tufting machines using standard needles can tuft 1,500 rows of stitches per minute, the hollow needle machines are at a considerable speed disadvantage. Accordingly, the need exists to design a hollow needle tufting apparatus where the needles may be compactly spaced thereby permitting a row of yarns to be completed in a smaller number of stitches. For instance, if hollow needles can be spaced every half inch, it will be possible to complete a row of stitches in only one-fourth the time that is required when the needles are spaced two inches apart. The result is that the tufting machine will be able to produce four times the amount of finished carpet in the same amount of time.

Due to the circular nature of the hollow needles, and the cutting mechanism utilized where a knife blade slides across an angled cutting surface at the end of the hollow needle, as described in Ingram U.S. Pat. No. 4,991,523, it is critical that the needle be properly aligned so that the knife blade makes uniform contact across the angled cutting surface. While truing the needle position when needles are spaced two inches apart laterally has been possible with some patience, when the needle spacing is reduced, frequently an adjustment to one needle will loosen an adjacent needle. Therefore, a mechanism is needed to precisely orient closely spaced needles without undue manual adjustment.

In addition to difficulties in properly orienting closely spaced needles, the penetration of backing fabric by closely spaced needles tends to drag the backing fabric downward resulting in yarn bights of uneven height and difficulties in implanting short yarn pile heights in the backing. The usual use of fingers extending from a backing support between needles is not practical in the case of hollow needle tufting apparatus due to the need to tuft a plurality of lateral stitches to create each row, which would drag tufted yarns across those needle fingers. Accordingly, an improved method of supporting backing fabric is needed.

In order to accomplish these and other objectives of the invention, an improved funnel assembly is provided with yarn spaced longitudinally fore and aft rather than annularly about the needle. The hollow needle itself is provided with a self aligning head so that the hollow needle is precisely set in a needle block with its angled cutting surface positioned to precisely cooperate with an associated knife.

An improved backing support plate is also provided to minimize the deflection of the backing fabric by the needles while still permitting lateral stitching.

BRIEF DESCRIPTION OF THE DRAWINGS

The particular features and advantages of the invention as well as other objects will become apparent from the follow description taken in connection with the accompanying drawing in which.

DETAILED DESCRIPTION OF THE DRAWINGS

Figure 1:
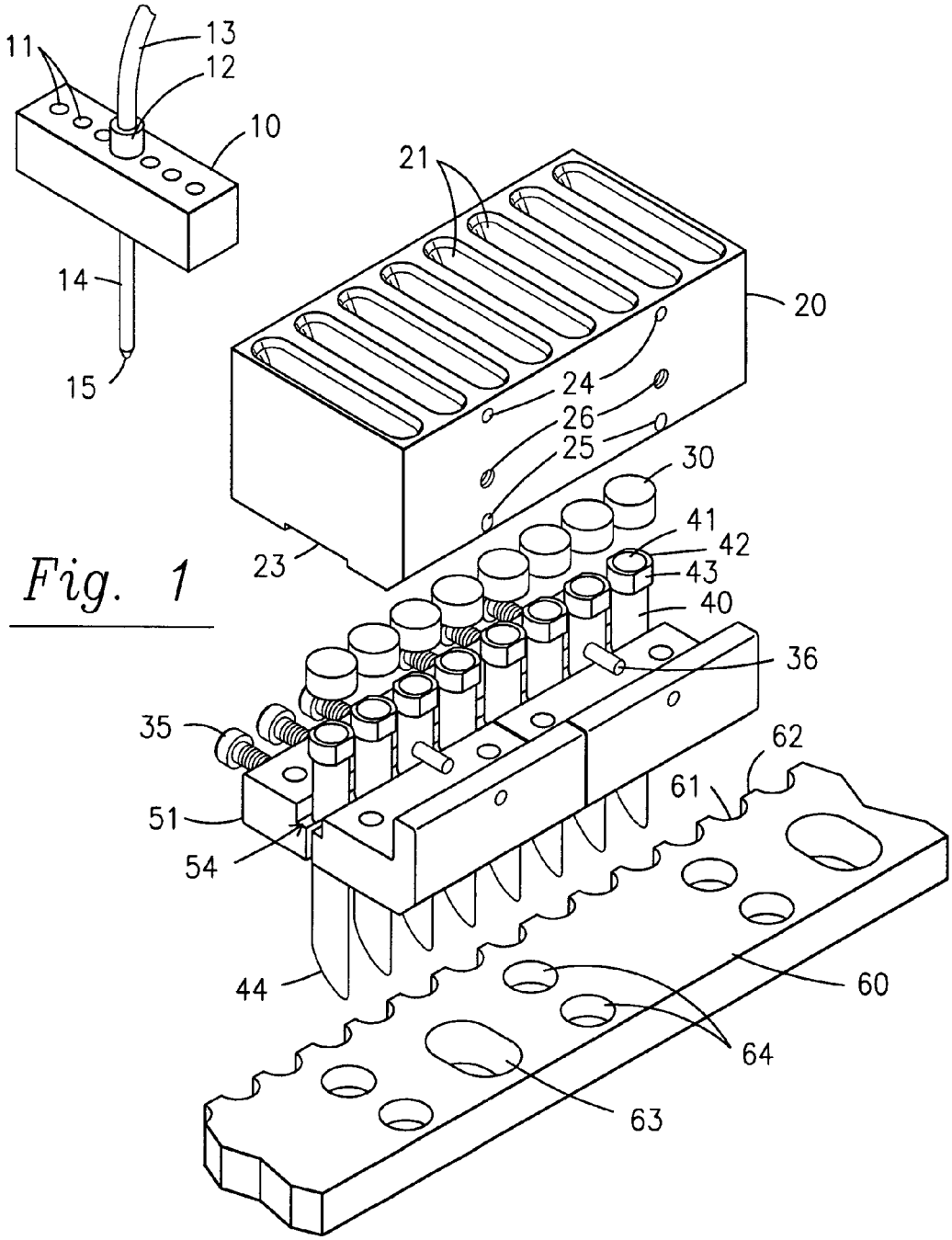
FIG. 1 is an exploded view of an embodiment of narrow gauge hollow needle tufting assembly of the present invention.

Turning first to FIG. 1, a cover plate 10 is shown with a yarn feed openings 11 proceeding in a longitudinal row. While the illustrated cover plate has six yarn feed openings, the alternative plate designs could be designed with two, four or eight yard feed openings 11. Through a central opening in cover plate 10 is collar 12 which receives an air supply line 13 at its upper end and it connects to tube 14 at its lower end, enabling the tube 14 to guide air downward to its outlet 15. Cover plate 10 fits over a longitudinal tapered slot 21 in frontal block 20. It will be appreciated that cover plate 10 rather than being designed to cover a single slot 21 could be made wider with longitudinal rows of yarn feed openings to cover a plurality of slots. In operation, yarns extend downward through openings 11 of the cover plate into a slot 21 of funnel block 20 and downward directed air pressure through openings 11 and gravity, keeps the yarns downwardly entrained within slot 21 and the jet of air proceeding from outlet 15 is designed to rapidly encourage a selective yarn downward and into the annular opening 41 of hollow tufting needle of 40 positioned beneath a selected tapered slot 21. The funnel block 20 also has a bottom channel 23 which allows some downwardly directed air flow to escape laterally rather than proceeding through the hollow needles of 40. Funnel block 20 also has lower pin holes 25 for mounting with pins 36 to front needle holder blocks 50, in addition to central threaded openings 26 and upper pin holes 24 for fastening purposes. At the bottom of slot 21 as cylindrical inserts 30 are inset and the funnel block 20 is mounted over hollow needle heads 42 so that the openings at the bottom tapered slots 21 ending in cylindrical inserts 30 are directly positioned over the openings 41 of hollow needles of 40. The heads of hollow needles 40 have at least one planar side 43, and in the illustrated embodiments have a pair of parallel opposed planar sides to facilitate alignment. Specifically, rear needle holder blocks 51 and front needle holder blocks 50 are joined by threaded allen bolts 35 in a fashion that leaves a channel 54 extending laterally across their joined upper surface. The channel 54 is defined by opposed planar sides. The opposed planar surfaces 53 of the heads 42 of hollow needles 40 align with the planar sides of the channel 54 to require the hollow needles 40 to be positioned so that the angled cutting surface 44 of needles 40 is precisely aligned in a rearward facing direction. With the two opposed planar surfaces 43 it will be seen that the angled cutting surface 44 could be aligned with the cutting surface 44 facing either directly forward or directly rearward, however the rearward direction is selected so that the cutting surface 44 can properly interface with knives 47, shown in FIG. 7.

Backing fabric for tufting is fed over backing support bar 60. Unlike prior backing support bars used with hollow needles, the backing support bar of the present invention 60 has a series of merlons 62 which are aligned to extend rearward between hollow needles 40 to about the mid point of those needles. Thus, the height of merlons 62 with respect to the interspaced arcuate hollows or crenels 61 is about equal to the radius of the hollow needles 40. The merlons 62 support the backing fabric against the downward pressure applied when angled surfaces 44 penetrate the backing fabric to insert stitches of yarn.

Figure 2A:
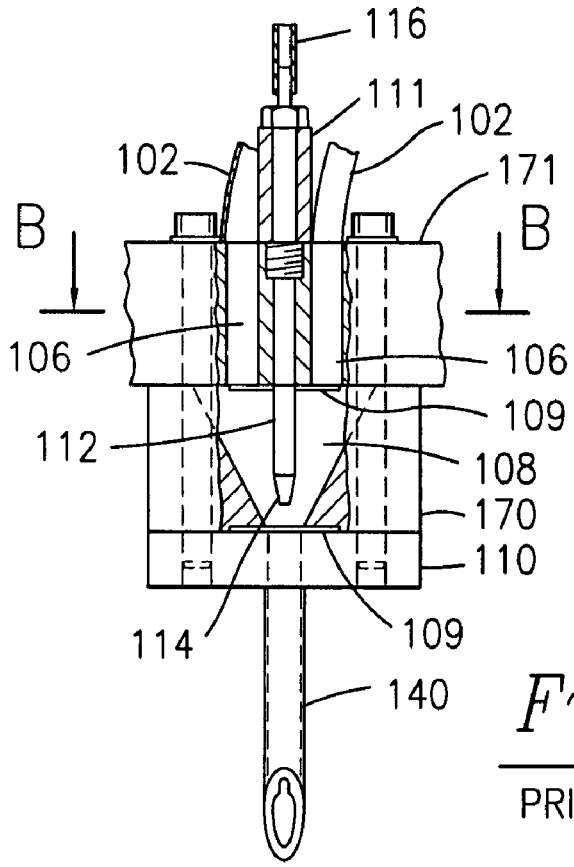
Fig. 2A PRIOR ART
FIG. 2A is a sectional rear plan view illustrating a prior art funnel assembly for a hollow needle.
Figure 2B:
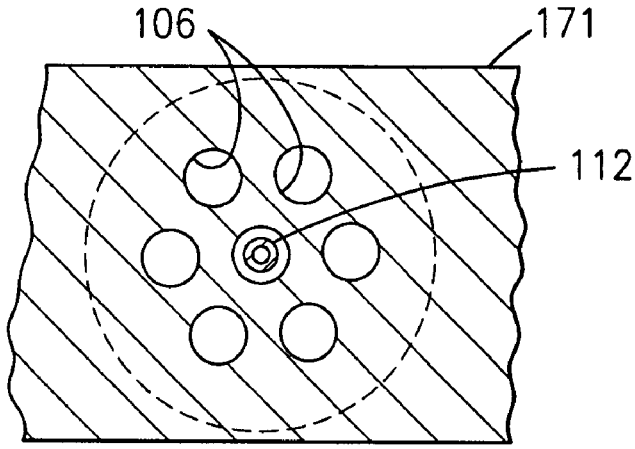
Fig. 2B PRIOR ART
FIG. 2B is a top sectional view of the yarn guide plate of FIG. 2A.

The lateral economy achieved by the novel designs of the invention can be appreciated in contrast to the prior art of hollow needle assembly depicted in FIGS. 2A and 2B. FIG. 2A shows an air supply line 116 introduced into a collar 111 and thereby through tube 112 to outlet 114 within the funnel shaped interior 108 of yarn exchange bar 170. Above the yarn exchange bar 170 is shown mounting bar 171 through which extends bores 106 which receive yarns from yarn supply tubes 102 thereby permitting ends of yarns to be received within funnel shaped interior 108. A lateral gap 190 allows some of the air supplied through yarn supply tubes 102 and tube 112 to escape laterally rather than being forced downward through a needle 140. The sectional view of mounting bar 171 shown in FIG. 2B shows that bores 106 are located in an annular orientation about a central bore which receives the pressurized air from supply line 116 and expels it downward through tube 112. The annular orientation of bores 106 and corresponding tapered annular configuration of funnel shaped interior space 108, consume lateral space across the tufting machine and in the prior art has made it generally impractical to achieve lateral spacing of hollow needles 140 more compact than two inch spacing between needle centers. Only one prototype and one production machine are known to have been made with less than two inch spacing between the needle centers, and these machines achieved only one inch spacing by positioning the annular funnel spaces so close together as to impede the connection of pushrods needed to communicate reciprocal movement to the needles.

Figure 3B:
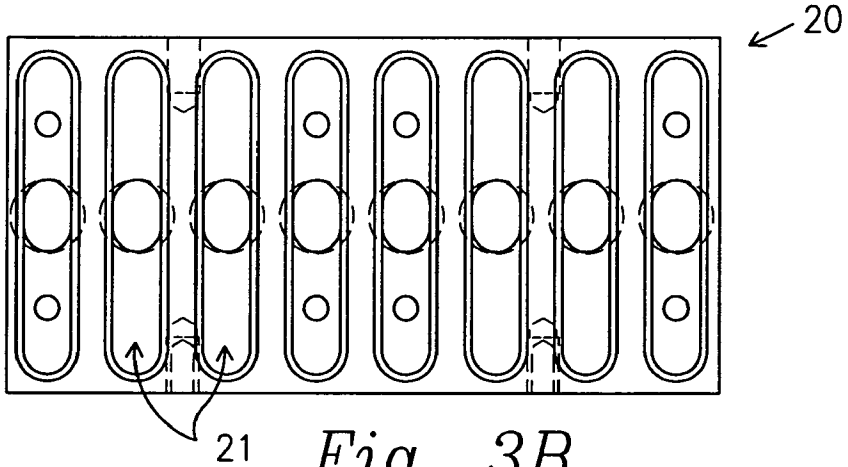
FIG. 3B is a top plan view of the funnel block of FIG. 3A.
Figure 3C:
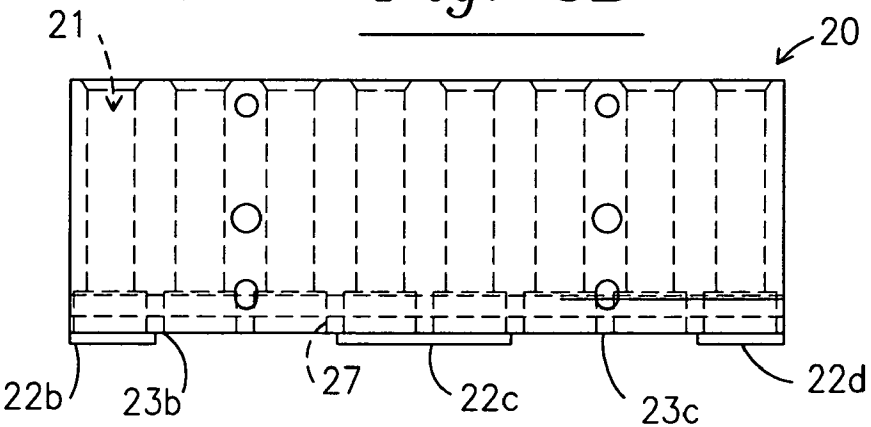
FIG. 3C is an front plan view of the funnel block of FIG. 3A.
Figure 3A:
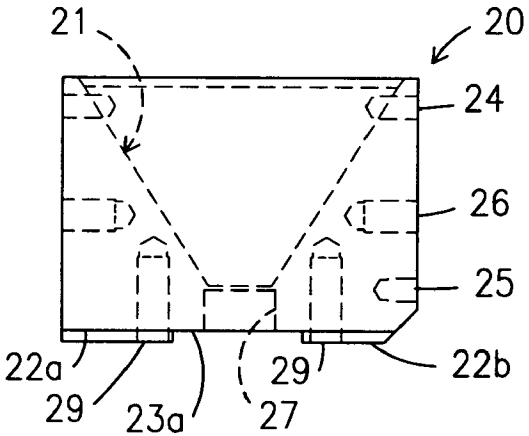
FIG. 3A is a side plan view of a funnel block of FIG. 1.
Figure 3D:
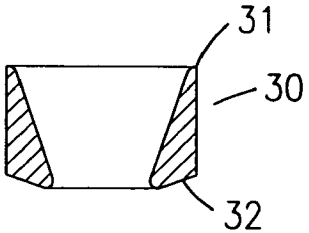
FIG. 3D is a side sectional view of an insert for the funnel block of FIG. 3A.

A principal method of economizing lateral space is illustrated in the funnel block shown in FIGS. 3A, 3B and 3C. The funnel block 20 has a plurality of longitudinal slots 21 which taper inward longitudinally toward the bottom. The intersecting lateral walls of the slots are nearly parallel. For ease of manufacture, the tapered slots 21 are cut in top of funnel block 20 and an orifice 27 is drilled in the bottom of funnel blocks 20. A cylindrical insert 30 shown in FIG. 3D is then press fit into the orifice 27 to provide a smooth transition for yarns extending downward into the slots 21. When press fit into orifice 27, the lower edge 32 of insert 30 preferably extends slightly below the center bottom surface 23*a* of funnel block 20.

As is shown in FIGS. 3A and 3C, the funnel block may preferably rest upon several short legs 22*a*, 22*b*, 22*c*, 22*d* spaced apart by channels defined by raised bottom surfaces 23*a*, 23*b*, 23*c*. The channels created by these raised bottom surfaces allow the lateral escape of air flowing downward through the slots 21. This assists in preventing any excess air pressure from backing up the slots 21. Funnel block 20 also has a number of side and bottom openings for mounting purposes. The pin holes 29 receive positioning pins from needle holder blocks 50, 51 to secure funnel block 20 in a fixed relation with those blocks 50, 51. Similarly pin holes 25 receive mounting pins 36 that are also received in openings 56 of the flange 59 of front needle holding block 50 (shown in FIG. 6A).

Figure 4:
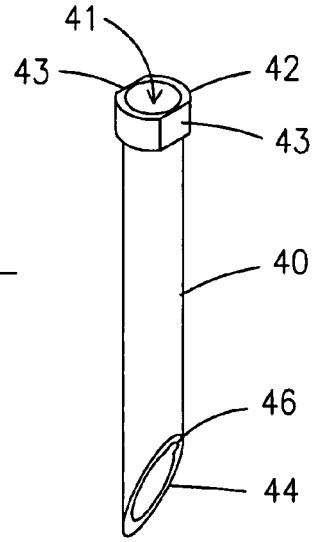
FIG. 4 is an isometric view a hollow needle of the type depicted in FIG. 1 shown in isolation.

FIG. 4 shows representative hollow needle 40 in isolation with head 42 having opposed planar sides 43. It will be appreciated that effective positioning may be accomplished with only a single planar side 43. The needle has a central opening 41 providing a tubular passage throughout the length of the needle 40 and a bottom angled cutting surface 44 across which cooperating knives cut when the needles are moved in well known reciprocal fashion. Notch 46 is provided to better position yarns for effective cutting.

Figure 5:
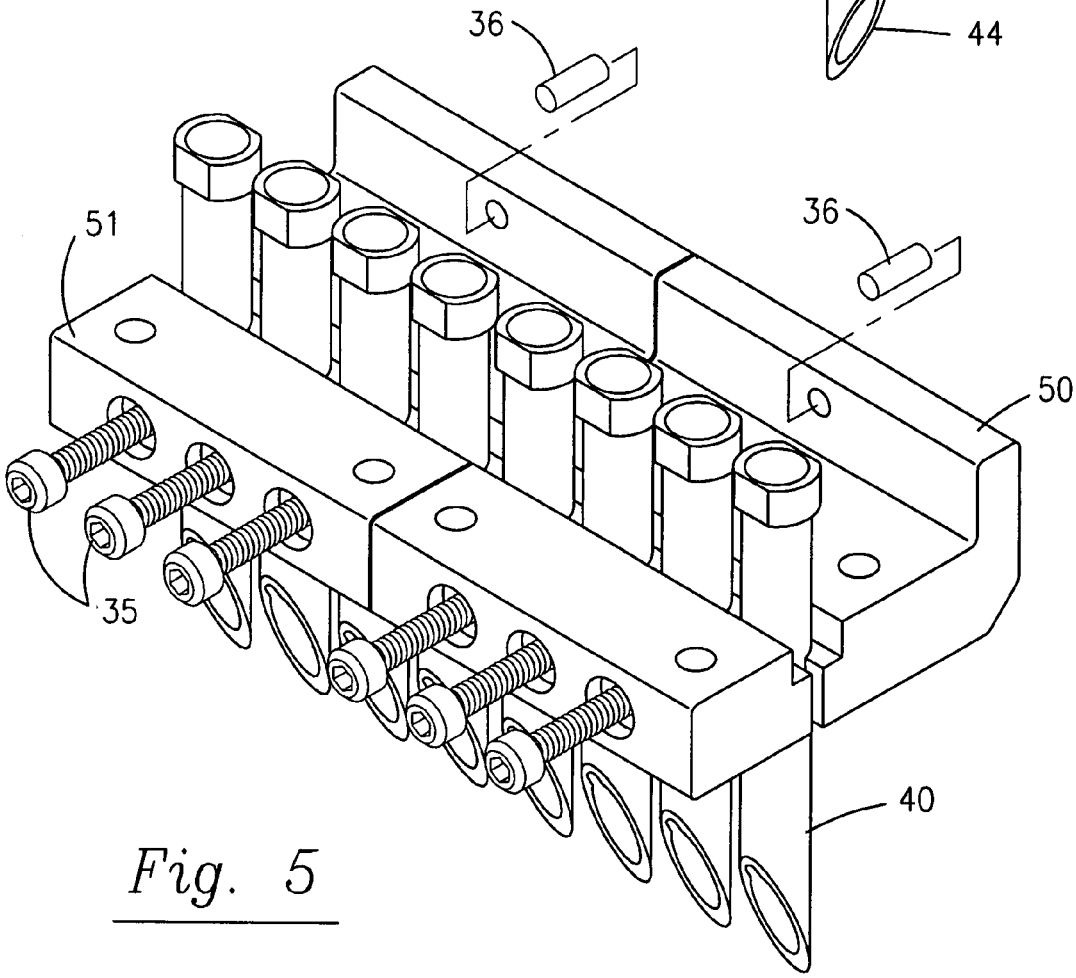
FIG. 5 is a reverse angle view of the hollow needles and needle holder of FIG. 1.
Figure 6A:
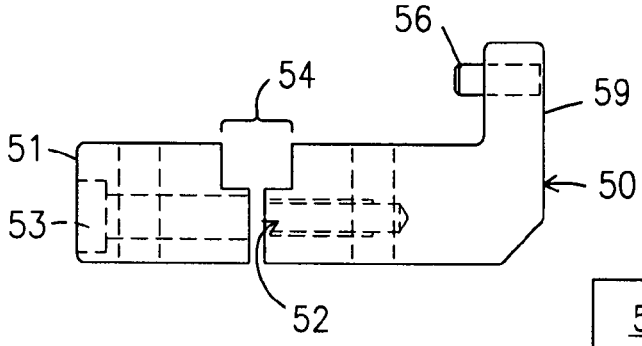
FIG. 6A is a side plan view of the needle holder of FIG. 1.
Figure 6B:
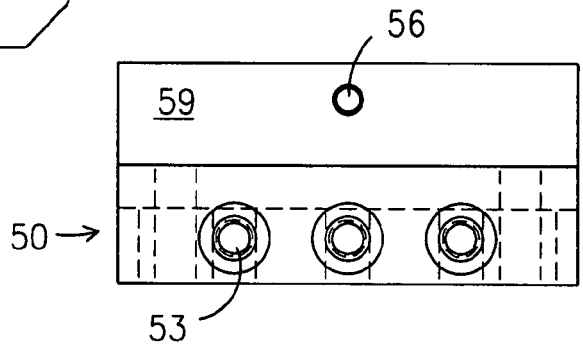
FIG. 6B is a rear plan view of the needle holder of FIG. 6A.
Figure 6C:
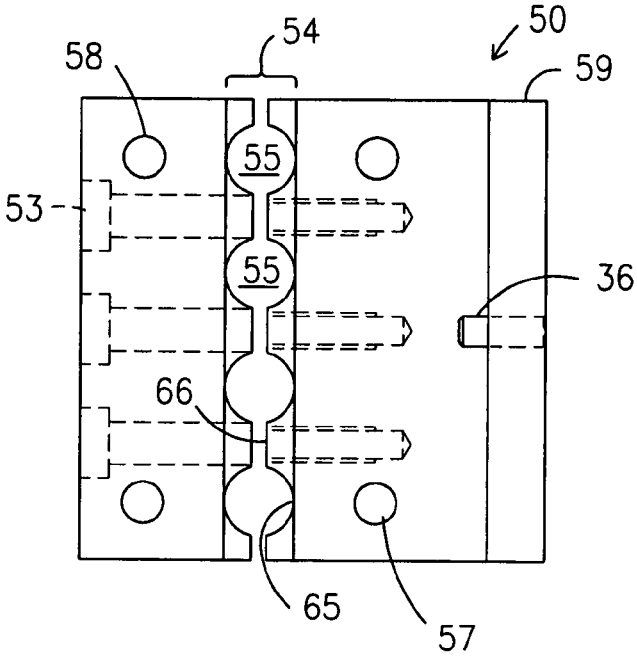
FIG. 6C is a top plan view of the needle holder of FIG. 6A.

FIG. 5 is a reverse angle view of the needle blocks 50, 51, allen bolts 35 and needles 40 shown in FIG. 1. FIG. 6A is a side view of the front needle block 50 and rear needle block 51 which are joined by placing a bolt 35 through opening 53 in the rear needle block 51 and fastening the bolt in threaded opening 52 of the front needle block 50 thereby creating a top channel 54 with planar parallel sides. Beneath the planar sides, the front and rear needle blocks 50, 51 have matching castellated surfaces with merlons 66 interspersed between arcuate hollows 65. The curves of the hollows 65 are adapted to fit around the outside curved walls of hollow needles of 40. When the allen bolts 35 pass through the merlons to hold the front and rear needle blocks 50, 51 together, tightening the bolts causes the parallel planar walls of channel 54 to interface with the planar sides 43 of the heads 42 of hollow needles 40, thereby aligning the bottom cutting surfaces 44 of needles 40 in a rearward direction. The matching hollows 65 also fit the bodies of the hollow needles 40 directly beneath the heads 42 to stabilize those needles. Front needle blocks 50 have a forward upper extending flange 59 that receives pin 56 to secure funnel blocks 20 that rest on the needle blocks 50, 51. In addition, openings 57 on front needle blocks 50 and openings 58 on rear needle blocks 51 may receive pin or day tonts to interface and secure the position of funnel blocks 20.

Figure 7:
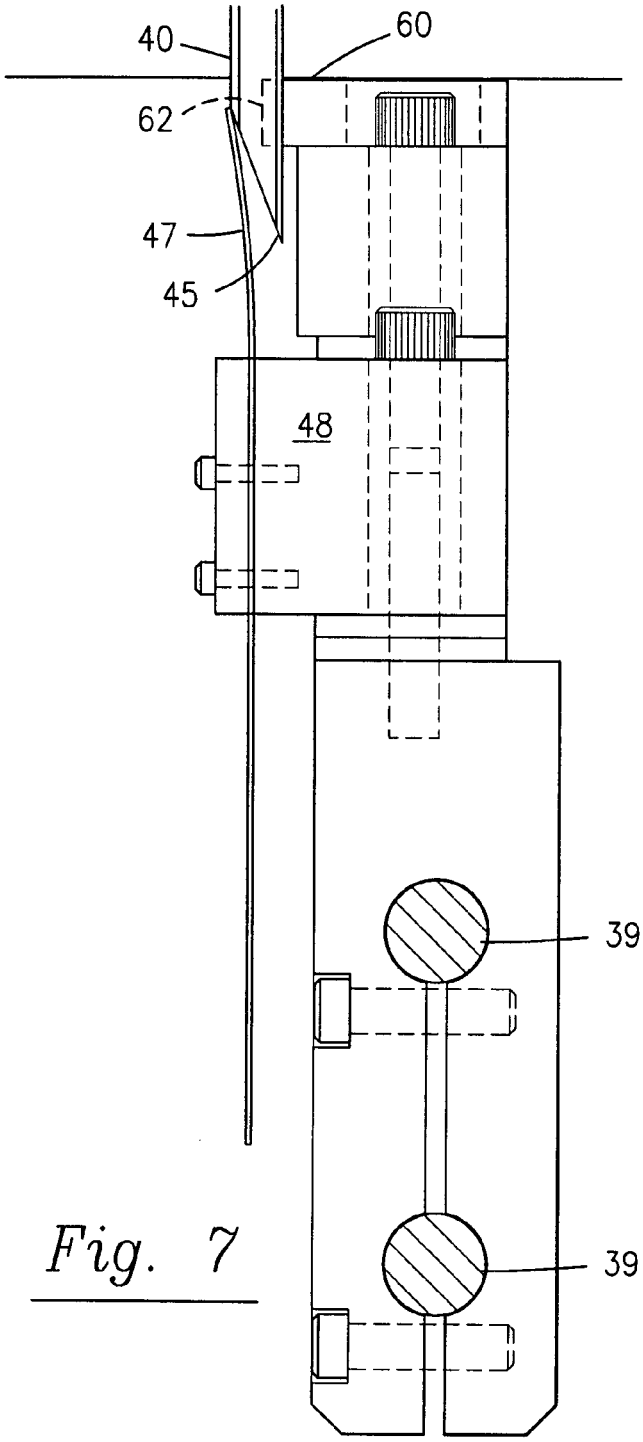
FIG. 7 is a side plan view showing relationship of a hollow needle to the backing support plate.
Figure 8:
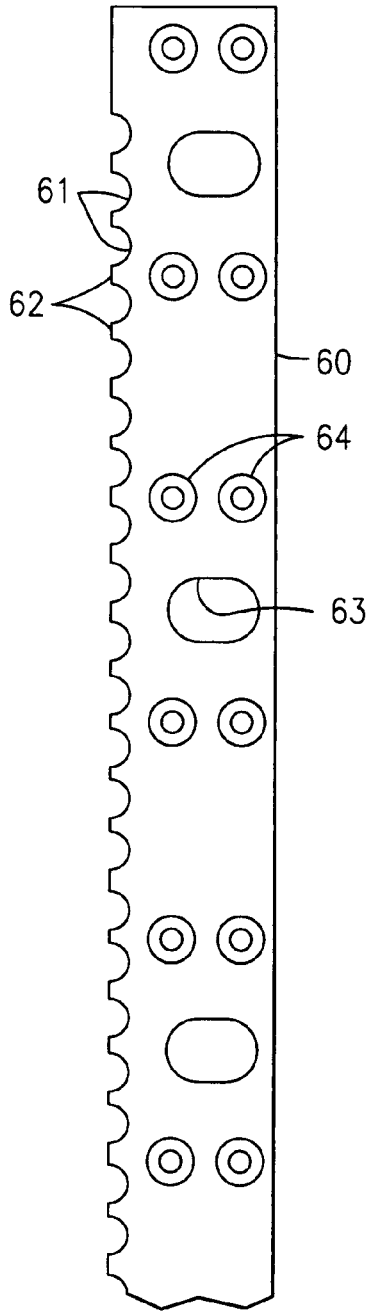
FIG. 8 is a top plan view of a backing support plate according to the invention.

FIGS. 7 and 8 illustrate the new configuration for backing support bar 60 utilized with closely spaced hollow needles 40 of the present invention. The backing support base 60 has openings 64 and slots 63 for mounting above the knife bar 48 which holds a plurality of laterally spaced knives 47. Backing fabric passes over backing support bar 60 and is supported by merlons 62 extending between hollow needles 40 which penetrate the backing fabric. By the downward tip 45 of the cutting surface 44 of needle 40 penetrating the backing fabric while located within crenels 61. In this fashion, the merlons 62 provide lateral support to the backing fabric and prevent the backing fabric from bending downward upon stitching and causing irregular heights in the resulting tufts of yarn or the complete inability to tuft short yarn height stitches. Preferably the entire assembly of backing support 60, at knife bar 48 and knives 47 may be shifted laterally as by being supported on bearing surfaces on laterally extending rods 39. In this fashion, by utilizing longitudinally aligned yarn feed openings, longitudinal funnel slots, self aligning needle heads, and castellated backing support bars, a narrow gauge hollow needle tufting may be effectively implemented.

Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

I claim:

1. In a tufting machine having a yarn feed supplying a plurality of yarns to each of a plurality of reciprocating laterally spaced hollow needles having heads and opposed angled ends, wherein a selected one of the plurality of yarns is fed into the head of a hollow needle and tufted by reciprocal movement of the needle through a backing fabric fed from front to back over a backing support, the selected one yarn exiting the angled end of the hollow needle being cut by a knife cooperating with the angled end to leave a yarn bight in the backing fabric, an improved narrow gauge configuration wherein the backing support is positioned forward of the laterally spaced hollow needles and has a crenellated rear edge wherein the head of a hollow needle has a planar edge that matches a planar section of a needle block holding said needle.

2. In a tufting machine having a yarn feed supplying a plurality of yarns to each of a plurality of reciprocating laterally spaced hollow needles having heads and opposed angled ends, wherein a selected one of the plurality of yarns is fed into the head of a hollow needle and tufted by reciprocal movement of the needle through a backing fabric fed from front to back over a backing support, the selected one yarn exiting the angled end of the hollow needle being cut by a knife cooperating with the angled end to leave a yarn bight in the backing fabric, an improved narrow gauge configuration wherein the backing support is positioned forward of the laterally spaced hollow needles and has a crenellated rear edge wherein the yarn feed supplies the plurality of yarns to a longitudinal slot tapering to an orifice located above the head of the hollow needle.

3. The narrow gauge configuration of claim 2 wherein each of the plurality of yarns proceeds through an opening in a longitudinal cover plate over the longitudinal slot.

4. In a tufting machine having a yarn feed supplying a plurality of yarns to each of a plurality of reciprocating laterally spaced hollow needles having heads and opposed angled ends, wherein a selected one of the plurality of yarns is fed into the head of a hollow needle and tufted by reciprocal movement of the needle through a backing fabric fed from front to back over a backing support, the selected one yarn exiting the angled end of the hollow needle being cut by a knife cooperating with the angled end to leave a yarn bight in the backing fabric, an improved narrow gauge configuration wherein the heads of the plurality of laterally spaced hollow needles each have a planar edge that matches a planar section of a needle block holding said needle.

5. The narrow gauge configuration of claim 4 wherein the backing support has a crenellated rear edge.

6. The narrow gauge configuration of claim 4 wherein the yarn feed supplies the plurality of yarns to a longitudinal slot tapering to an orifice adjacent the head of the hollow needle.

7. The narrow gauge configuration of claim 6 wherein each of the plurality of yarns proceeds through an opening in a longitudinal cover plate over the longitudinal slot.

8. In a tufting machine having a yarn feed supplying a plurality of yarns to each of a plurality of reciprocating laterally spaced hollow needles having heads and opposed angled ends, wherein a selected one of the plurality of yarns is fed into the head of a hollow needle and tufted by reciprocal movement of the needle through a backing fabric fed from front to back over a backing support, the selected one yarn exiting the angled end of the hollow needle being cut by a knife cooperating with the angled end to leave a yarn bight in the backing fabric, an improved narrow gauge configuration wherein the yarn feed supplies the plurality of yarns to a longitudinal slot tapering to an orifice over the head of the hollow needle.

9. The narrow gauge configuration of claim 8 wherein each of the plurality of yarns proceeds through an opening in a longitudinal cover plate over the longitudinal slot.

10. The narrow gauge configuration of claim 9 wherein the plurality of yarns comprises six yarns proceeding through six openings in the longitudinal cover plate.

11. The narrow gauge configuration of claim 8 wherein a funnel block comprises a plurality of longitudinal slots.

12. The narrow gauge configuration of claim 11 wherein the hollow needles and funnel block shift laterally between stitches.

13. The narrow gauge configuration of claim 8 wherein the backing support and knives shift laterally between stitches.

14. A tufting machine having:

(a) a yarn feed feeding selected ones of a plurality of yarns supplied to needles in accordance with a pattern, (b) a longitudinal slot into which the plurality of yarns is directed, said slot tapering to an orifice;

(c) a hollow needle having a head adjacent to the orifice and an opposed angled end;

(d) pressurized gas supplied to the longitudinal slot to urge the selected ones of the plurality of yarns through the orifice and the head of the hollow needle to extend out the angled end.

15. The tufting machine of claim 14 further comprising the hollow needle head having a planar edge that matches a planar section of a needle block holding said needle.

16. The tufting machine of claim 14 wherein the needle block defines a channel with planar parallel sides and the hollow needle head has opposed planar sides interfitting within said channel.

17. The tufting machine of claim 14 wherein a backing fabric is fed from front to rear through the tufting machine over a backing support plate having a crenellated rear edge.

18. The tufting machine of claim 14 wherein the longitudinal slot has a longitudinal cover with longitudinally aligned openings through which the plurality of yarns enter the slot.

* * * * *